US007125274B1

(12) United States Patent
Ju et al.

(10) Patent No.: US 7,125,274 B1
(45) Date of Patent: Oct. 24, 2006

(54) ELECTRICAL CONNECTOR

(75) Inventors: Ted Ju, Keelung (TW); Wen-Chang Chang, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/263,943

(22) Filed: Nov. 2, 2005

(51) Int. Cl.
*H01R 4/50* (2006.01)
*H01R 13/62* (2006.01)

(52) U.S. Cl. ..... 439/342; 439/331

(58) Field of Classification Search ..... 439/342, 439/259, 260–268, 330–331
See application file for complete search history.

(56) References Cited

U.S. PATENT DOCUMENTS 4,512,621 A * 4/1985 Bethurum ..... 439/395
4,519,660 A * 5/1985 Ichimura et al. ..... 439/296
5,454,727 A * 10/1995 Hsu ..... 439/263
6,247,954 B1 * 6/2001 Ju ..... 439/342
6,264,490 B1 * 7/2001 Lemke et al. ..... 439/342
6,699,055 B1 * 3/2004 Peng et al. ..... 439/342

* cited by examiner

*Primary Examiner*—Hien Vu
(74) *Attorney, Agent, or Firm*—Troxell Law Office, PLLC

(57) ABSTRACT

An electrical connector for connection between a chip module and a circuit board is disclosed to include a housing defining a plurality of terminal slots, first terminals respectively mounted in the terminal slots, second terminals respectively mounted in the terminal slots and movable relative to the first terminals for compression contact with the first terminals respectively, a holding down cover for holding down the chip module on the terminal terminals, and a locking lever for locking the holding down cover.

10 Claims, 9 Drawing Sheets

ELECTRICAL CONNECTOR

BACKGROUND OF THE INVENTION

1. Field of the Invention

The present invention relates to electrical connectors and more particularly, to an electrical connector designed for compression contact with a chip module.

2. Description of the Related Art

Currently, some electronic products (such as computers) use a LGA (Land grid array) module for performance enhancement. A LGA module uses laminate substrate to form the landing pad and the exposed pad. A conventional electrical connector for use with a LGA module, as shown in FIGS. 15 and 16, an electrically insulative housing 100, a plurality of terminals 200 respectively mounted in the electrically insulative housing 100, and a plurality of solder balls 300 respectively provided at the bottom side of each of the terminals 200 and soldered to a circuit board (not shown). Each terminal 200 has a body 400, a bottom mounting portion 500 extending from the bottom side of the body 400 for bonding to the circuit board, and a top contact portion 600 for the contact of a chip module. These terminal 200 have a high conductivity. However, it is difficult to install the terminals 200 in the electrically insulative housing 100. Further, the terminals 200 wear quickly with use and may be permanently deformed, affecting electric connection between the chip module and the circuit board.

Therefore, it is desirable to provide an electrical connector that eliminates the aforesaid drawbacks.

SUMMARY OF THE INVENTION

The present invention has been accomplished under the circumstances in view. It is the main object of the present invention to provide an electrical connector, which is easy to install and wear resistant, and provides a positive electric connection between the external electronic device and the circuit board.

To achieve this and other objects of the present invention, the electrical connector comprises a body, which has a plurality of terminal slots, a plurality of first terminals respectively mounted in the terminal slots and partially extending out of a top side of the body, a plurality of second terminals respectively mounted in the terminal slots for compression contact with the first terminals respectively, a holding down cover coupled to one side of the body and adapted to hold down an external electronic device on the first terminals, and a locking lever coupled to one side of the body opposite to the holding down cover and adapted to lock the holding down cover.

DETAILED DESCRIPTION OF THE PREFERRED EMBODIMENT

Figure 1:
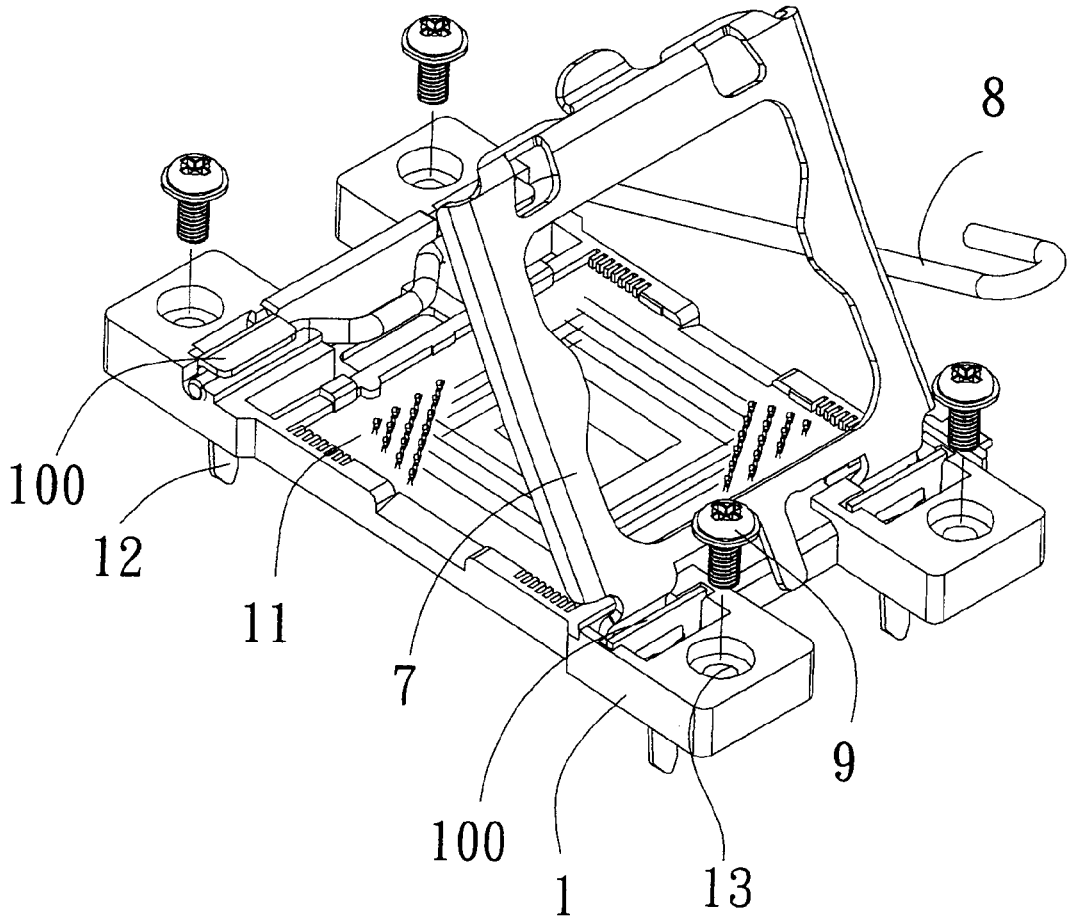
FIG. 1 is a perspective view of an electrical connector according to a first embodiment of the present invention, showing the unlocked status of the holding down cover.
Figure 2:
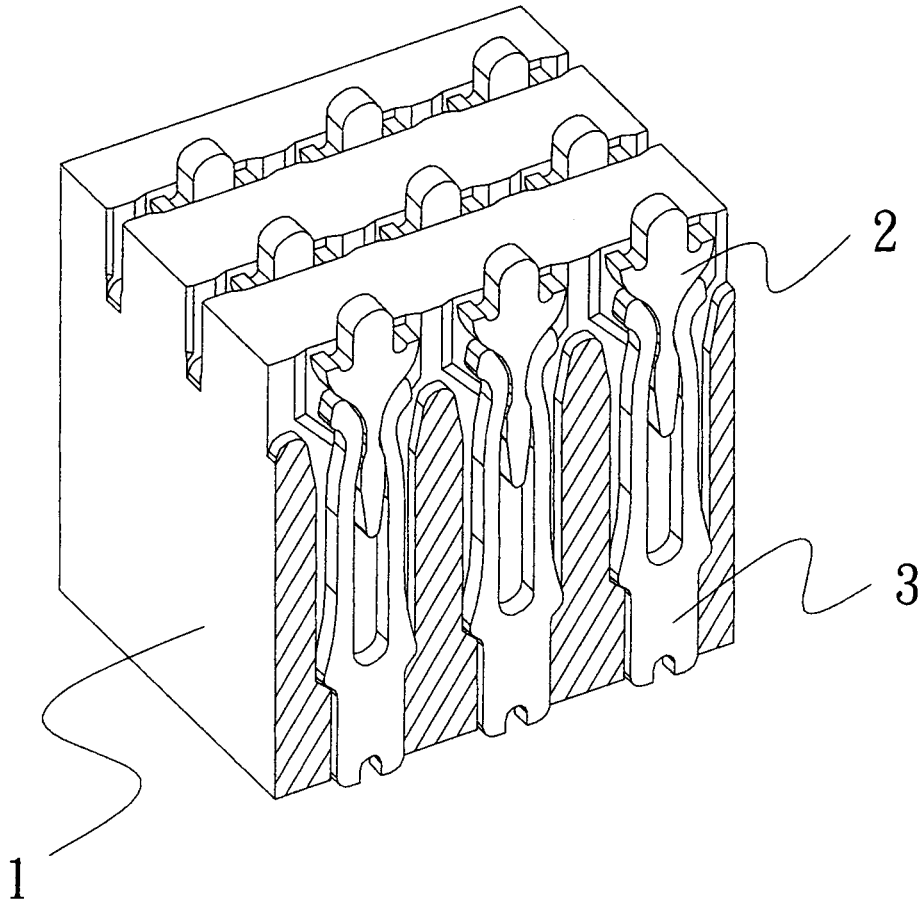
FIG. 2 is a sectional elevation of a part of the electrical connector according to the first embodiment of the present invention, showing the positioning of the first terminals and the second terminals in the respective terminal slots.
Figure 3:
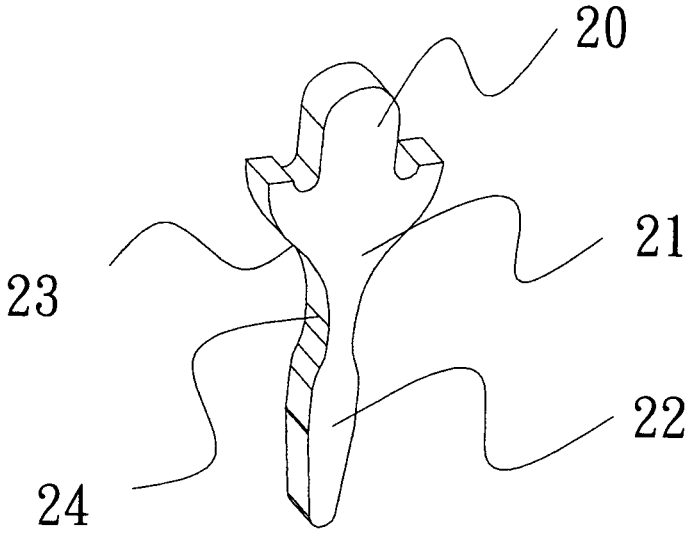
FIG. 3 is an elevational view of one first terminal for the electrical connector according to the first embodiment of the present invention.
Figure 4:
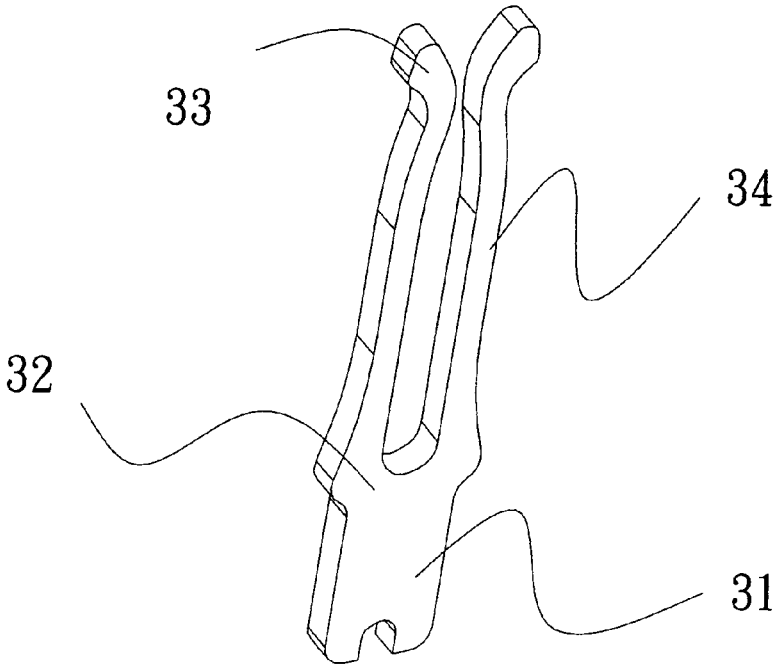
FIG. 4 is an elevational view of one second terminal for the electrical connector according to the first embodiment of the present invention.
Figure 5:
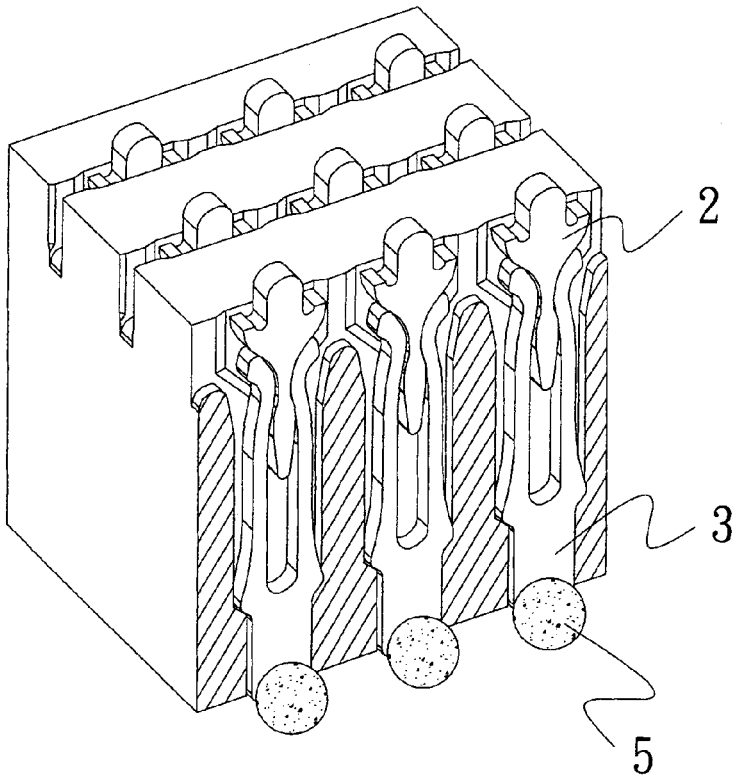
FIG. 5 is a sectional elevation of a part of the electrical connector according to the first embodiment of the present invention, showing the bottom side of each second terminal provided with a solder material.
Figure 6:
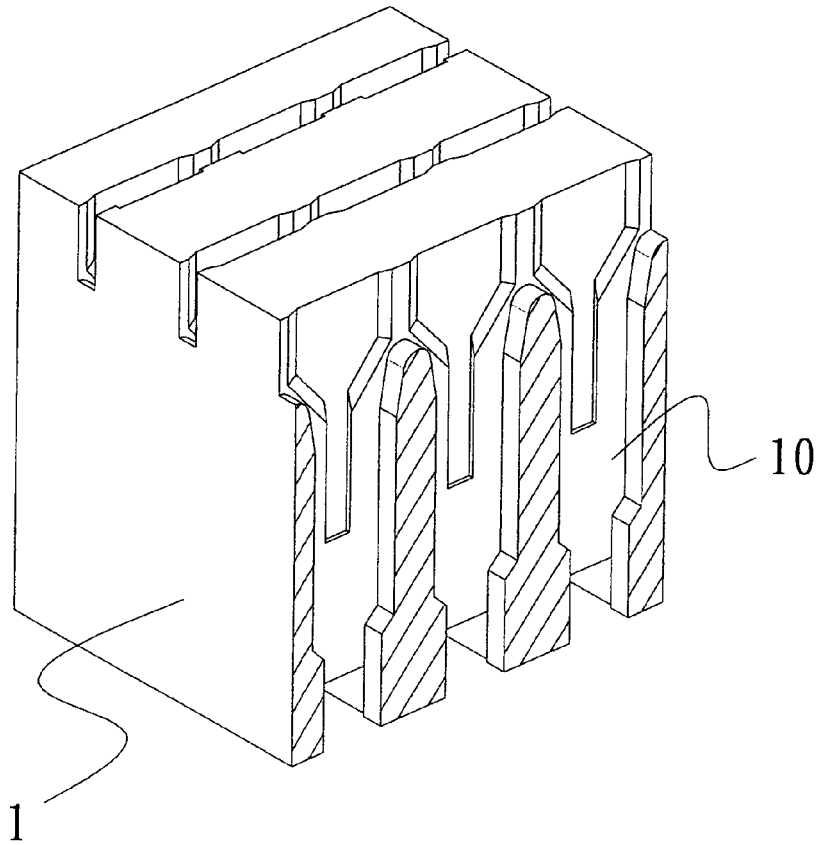
FIG. 6 is a sectional elevation of the electrically insulative housing of the electrical connector according to the first embodiment of the present invention.

Referring to FIGS. 1~8, an electrical connector in accordance with the first embodiment of the present invention is shown for connecting an external electronic device, for example, a chip module 4 to a circuit board or the like (not shown), comprising an electrically insulative housing 1, first terminals 2 and second terminals 3 mounted in the electrically insulative housing 1 to electrically connect the chip module 4 to the circuit board, a holding down cover 7 hinged to one side of the housing 1 and adapted to hold down the chip module 4 on the housing 1 in close contact with the terminals, a locking lever 8 pivoted to the opposite side of the housing 1 and adapted to lock the holding down cover 7, and fastening means 9 for fixedly securing the electrically insulative housing 1 to the circuit board (not shown).

The housing 1 has a plurality of mounting through holes 13 cut through the top and bottom walls in the four corners for the mounting of the fastening means 9. According to this embodiment, the fastening means 9 is comprised of screw bolts respectively mounted in the mounting through holes 13 to affix the housing to the circuit board. The housing 1 further has a top recess 11 adapted to accommodate the chip module 4, two locating frames 100 disposed at two sides of the top recess 11 for receiving the holding down cover 7 and the locating lever 8 respectively, a plurality of bottom positioning rods 12 for fastening to the circuit board, and a plurality of terminal slots 10 formed in the top recess 11 and cut through the top and bottom sides of the housing 1. The first terminals 2 are respectively mounted in the terminal slots 10 of the housing 1 and protruding over the top recess 11 for compression by the chip module 4. The second terminals 3 are respectively mounted in the terminal slots 10 of the housing 1 for the contact of the respective first terminals 2, each having a bottom side provided with a solder material 5. The first terminals 2 are movable relative to the second terminals 3. When compressed by the chip module 4, the first terminals 2 are forced into positive contact with the respective second terminals 3, and therefore the chip module 4 is electrically connected to the circuit board through the first terminals 2 and the second terminals 3. The first terminals 2 and the second terminals 3 are metal plate members made of different metal materials having different conductivity.

The first terminals 2 and the second terminals 3 may be arranged in parallel or on the same plane. Each first terminal 2 has a top contact portion 20 that protrudes over the top recess 11 for the contact of the chip module 4, a bottom press portion 21 for pressing the respective second terminal 3, two sloping surface portions 23 downwardly inwardly disposed at two opposite lateral sides between the top contact portion 20 and the bottom press portion 21, and two locating grooves 24 symmetrically disposed at the two opposite lateral side walls of the bottom press portion 21. The second terminals 3 are forked metal plate members, each having a bottom mounting portion 31 for bonding to an external electronic device (according to this embodiment, this external electronic device is the aforesaid circuit board) with a solder material (not shown), and a forked resilient support 32 formed of two spring arms 34. The spring arms 34 each have a bearing portion 33. The bottom press portion 21 of each first terminal 2 is inserted into the gap between the two top spring arms 32 of the respective second terminal 3 and stopped against the topmost edge of the bottom mounting portion 31 of the respective second terminal 3 with the respective slopping surface portions 23 abutted against the respective The spring arms 34 of the respective second terminal 3 and the respective locating grooves 24 kept in engagement with the respective bearing portions 33 of the respective second terminals 3. Further, the solder material 5 is fixedly provided at the bottom side of the mounting portion 31 for bonding to the circuit board.

Figure 7:
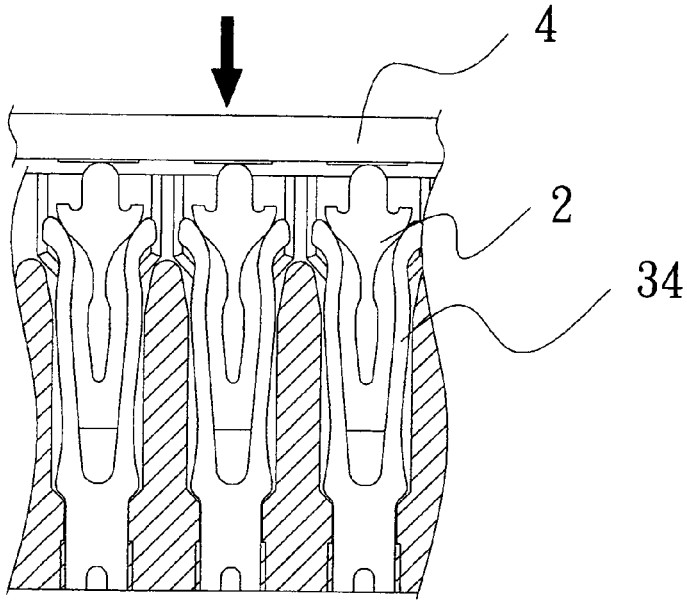
FIG. 7 is a schematic drawing showing the installation of a chip module in the electrical connector according to the first embodiment of the present invention.
Figure 8:
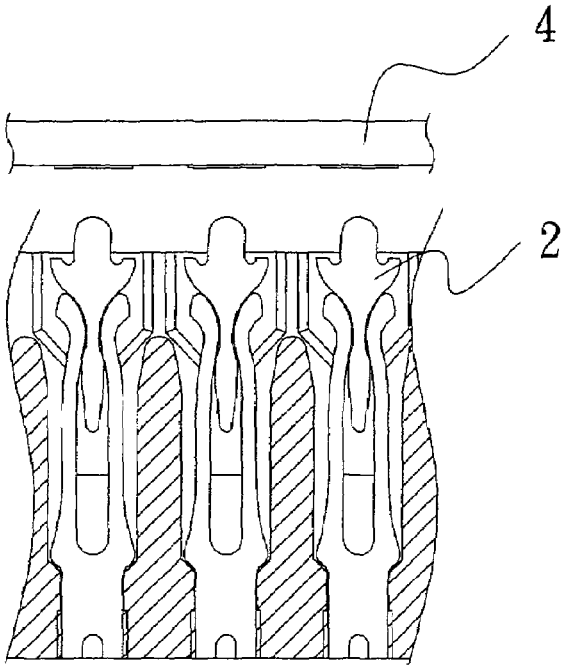
FIG. 8 shows the status of the first terminals in the respective terminal slots of the housing before loading of the chip module according to the first embodiment of the present invention.

Referring to FIGS. 7 and 8, when mounting the chip module 4, the first terminals 2 will be forced downwards by the chip module 4, and the top spring arms 34 of each second terminal 3 will be forced to curve outwards by the sloping surface portions 23 of the respective first terminal 2. After removal of the chip module 4 from the first terminals 2, the top spring arms 34 of the second terminals 3 immediately return to their former shape to push the respective first terminals 2 upwards to their former position. Thus the electrical connector achieves the function of the so-called compression contact type electrical connector.

Figure 9:
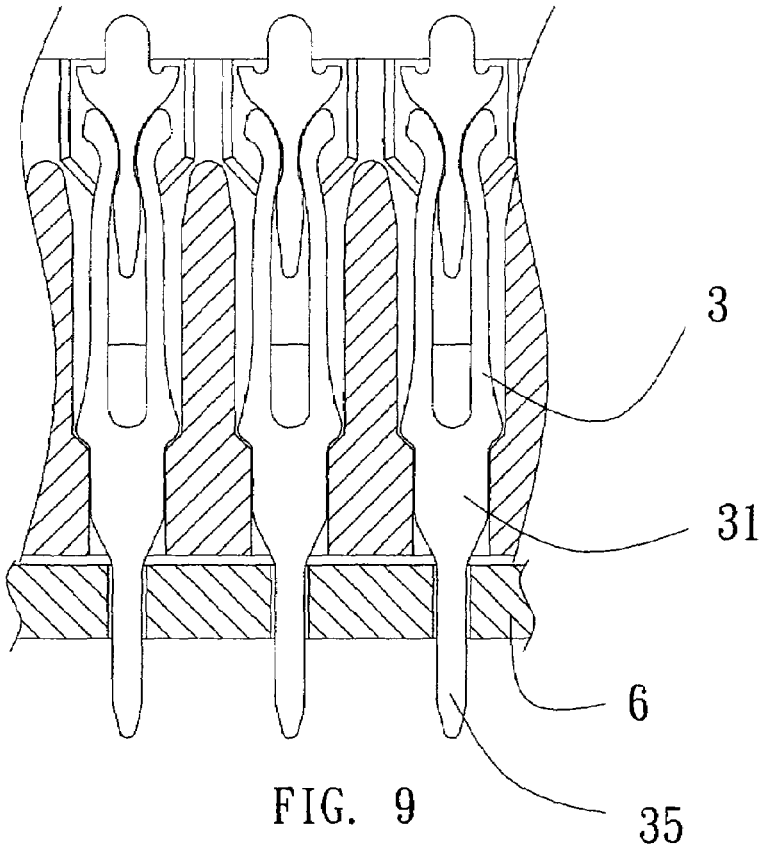
FIG. 9 is a sectional view of a part of an electrical connector according to a second embodiment of the present invention.

FIG. 9 is a sectional view of a part of an electrical connector according to the second embodiment of the present invention. According to this embodiment, each second terminal 3 has a bonding tip 35 downwardly extending from the mounting portion 31 and inserted through a respective via hole at the circuit board 6 and then fixedly soldered to the respective via hole.

Figure 10:
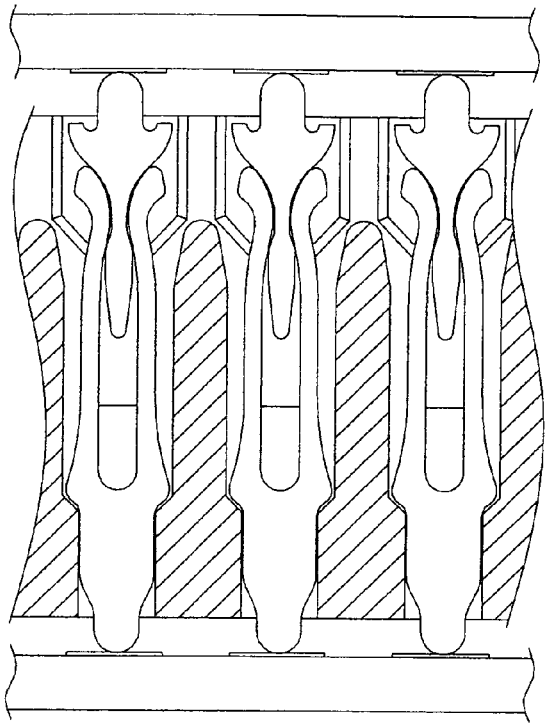
FIG. 10 is a schematic sectional view of an electrical connector according to a third embodiment of the present invention.

FIG. 10 is a schematic sectional view of an electrical connector according to the third embodiment of the present invention. According to this embodiment, the aforesaid solder material is eliminated, and the mounting portion 31 of each second terminal 3 extends out of the bottom side of the housing for direct contact with the circuit board.

Figure 11:
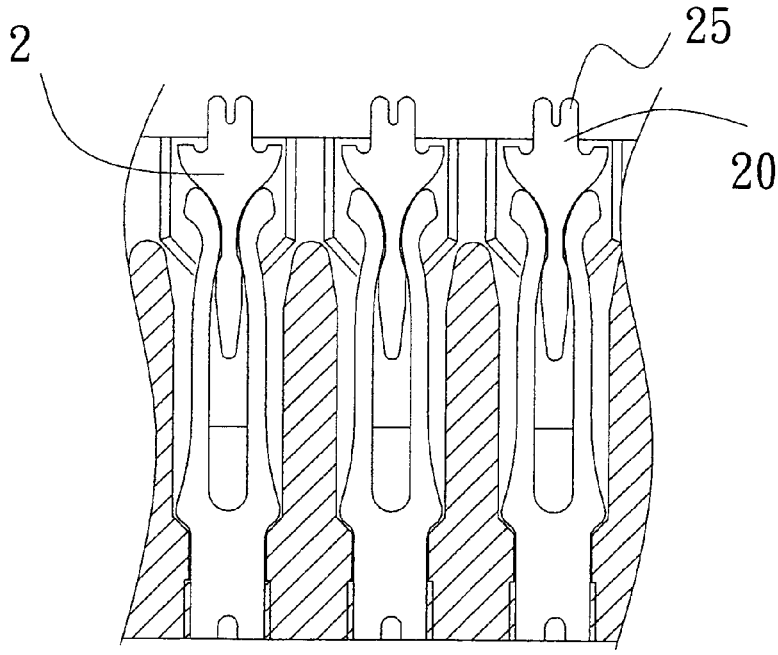
FIG. 11 is a schematic sectional view of an electrical connector according to the fourth embodiment of the present invention.

FIG. 11 is a schematic sectional view of an electrical connector according to the fourth embodiment of the present invention. According to this embodiment, the contact portion 20 of each first terminal 2 is notched, thereby forming two contacts 25.

Figure 12:
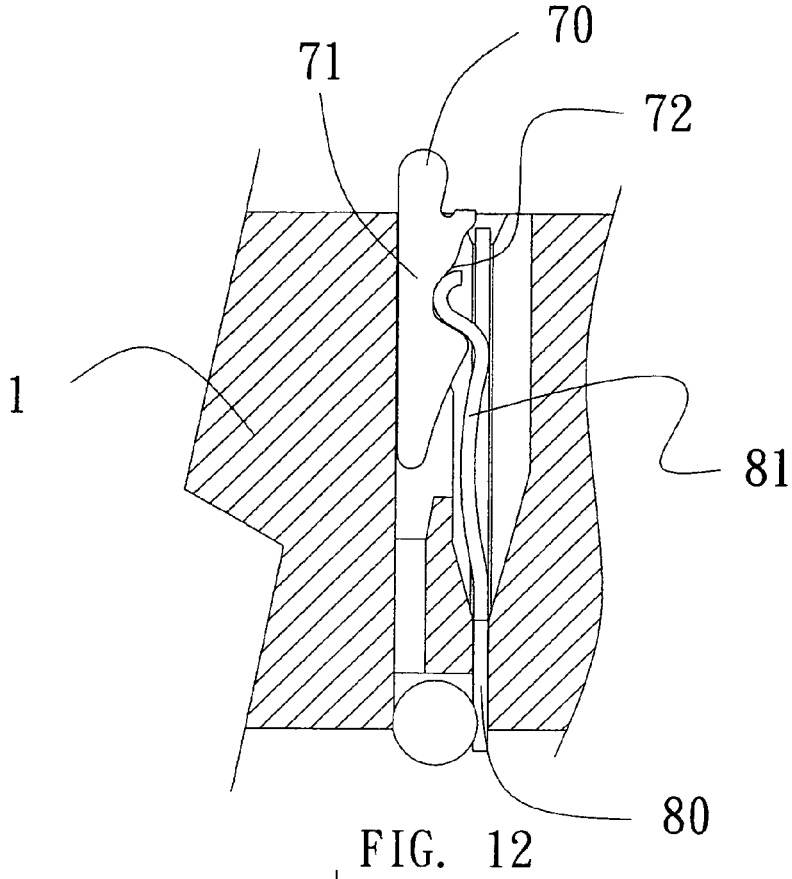
FIG. 12 is a schematic sectional view of an electrical connector according to the fifth embodiment of the present invention.
Figure 13:
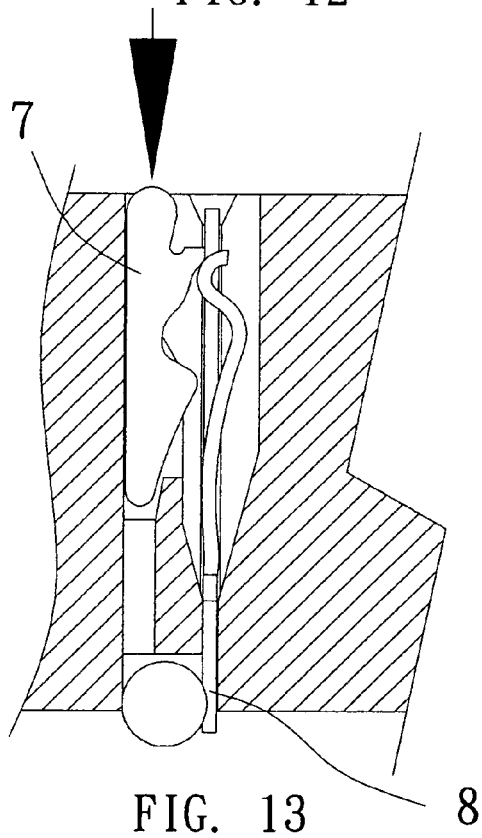
FIG. 13 corresponds to FIG. 12, showing the first terminal moved downwards.

FIGS. 12 and 13 show an electrical connector according to the fifth embodiment of the present invention. According to this embodiment, each first terminal 7 has a top contact portion 70 for the contact of the chip module, and a bottom press portion 71 for pressing the respective second terminal 8. The bottom press portion 71 has at least one sloping surface 72 facing the respective second terminal 8. Each second terminal 8 has a mounting portion 80 disposed at one end for connection to the circuit board, and resilient bearing means, for example, a spring arm 81 disposed at the other end and extending in direction substantially perpendicular to the bottom press portion 71 of the respective first terminal 7. When the first terminal 7 receives a downward pressure as shown in FIG. 13, one sloping surface 72 of the first terminal 7 is pressed against the spring arm 81, and the opposite side of the bottom press portion 71 of the first terminal 7 is forced against the inside wall of the housing 1. Therefore, this embodiment achieves the same compress contact effect.

Figure 14:
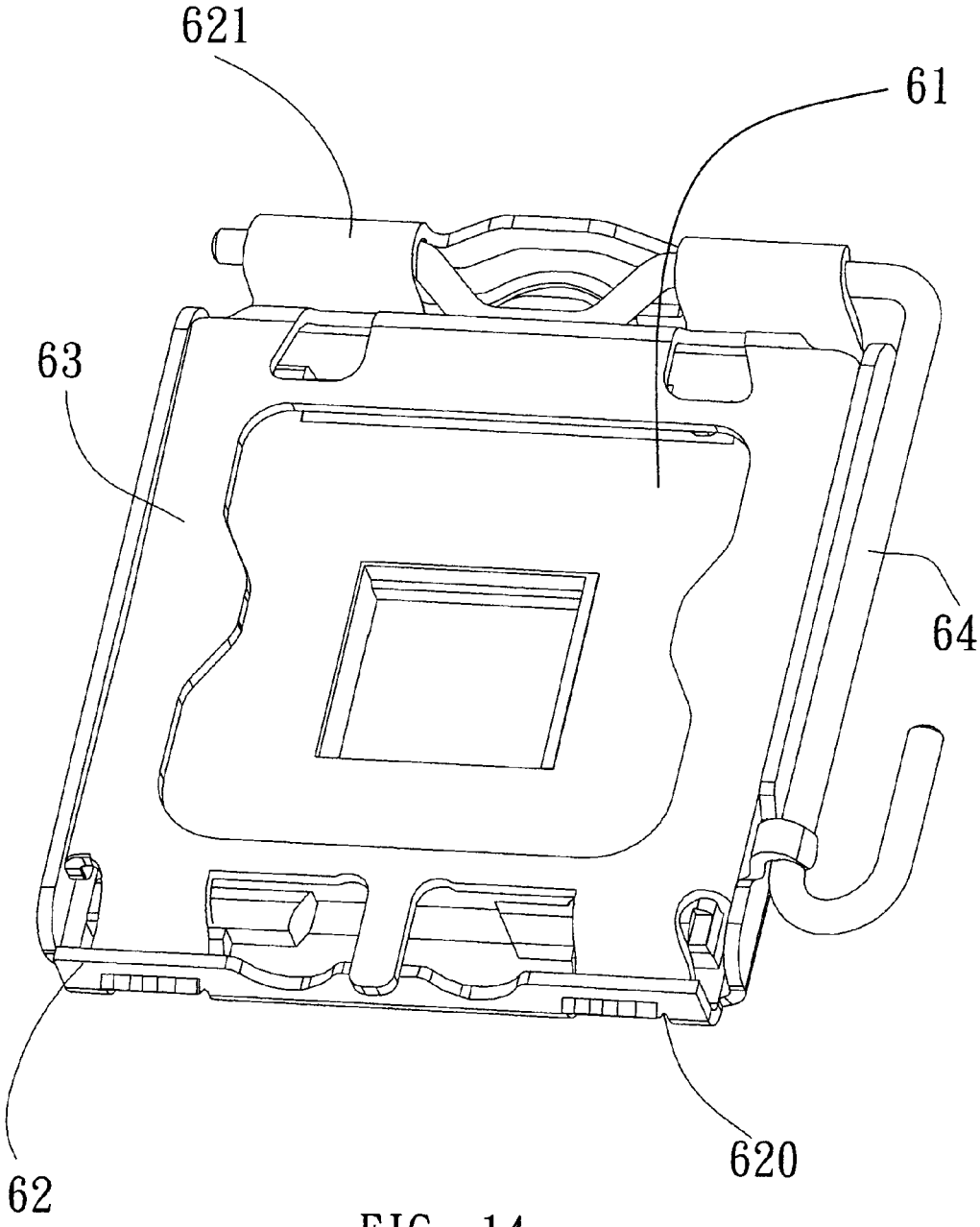
FIG. 14 is a perspective view of an electrical connector according to a sixth embodiment of the present invention.
Figure 15:
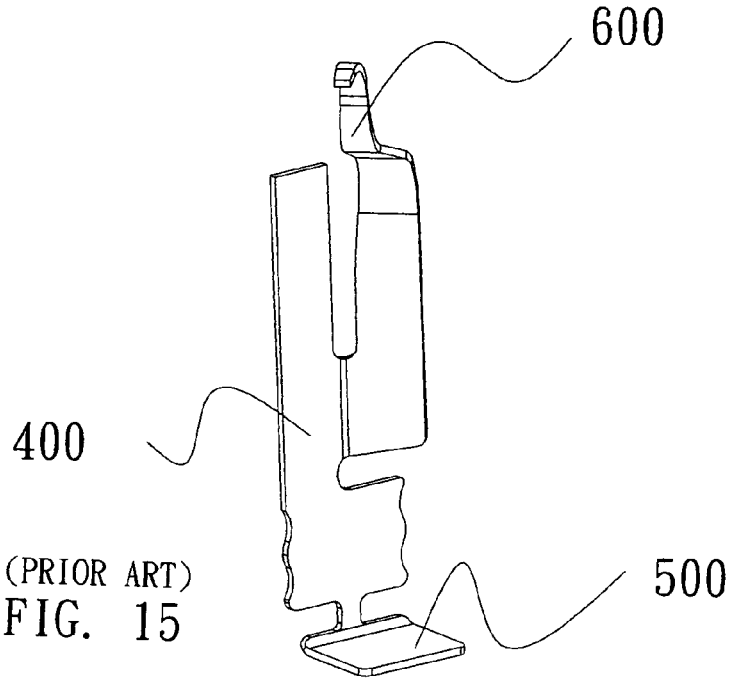
(PRIOR ART) FIG. 15
FIG. 15 is an elevational view of a terminal for an electrical connector according to the prior art.
Figure 16:
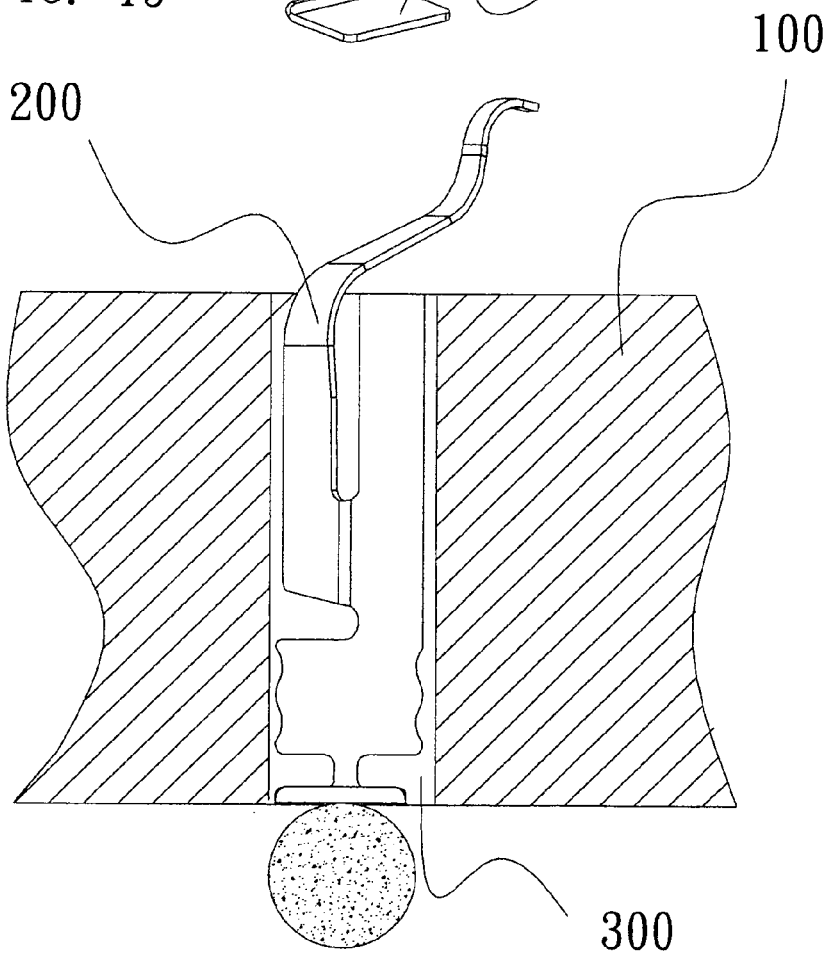
(PRIOR ART) FIG. 16
FIG. 16 is a sectional view of the prior art electrical connector.

FIG. 14 is a perspective view of an electrical connector according to a sixth embodiment of the present invention. According to this embodiment, the electrical connector comprises an electrically insulative housing 61, which holds a set of terminals (not shown) on the inside for electrically connecting a chip module to a circuit board, a holder frame 62, which accommodates the housing 61 and has hinge means 621 at one side and knuckles 621 at the opposite side, a holding down cover 61 fastened to the hinge means 621 and turnable relative to the holder frame 62 between a close position and an open position, and a locking lever 64 pivotally connected to the knuckles 621 and adapted to lock the holding down cover 61.

Although particular embodiments of the invention have been described in detail for purposes of illustration, various modifications and enhancements may be made without departing from the spirit and scope of the invention.

The invention claimed is:

1. An electrical connector comprising:

a body, said body housing having a plurality of terminal slots;

a plurality of first terminals respectively mounted in said terminal slots and partially extending out of a top side of said body;

a plurality of second terminals respectively mounted in said terminal slots for compression contact with said first terminals respectively;

a holding down cover coupled to one side of said body and adapted to hold down an external electronic device on said first terminals; and a locking lever coupled to one side of said body opposite to said holding down cover and adapted to lock said holding down cover;

wherein said body comprises at least one mounting through hole cut through top and bottom sides thereof, and fastening means mounted in said at least one mounting through hole for affixing said body to a circuit board;

wherein said body has locating frames fixedly mounted therein, said holding down cover and said locking lever are respectively pivotally coupled to said locating frames.

2. The electrical connector as claimed in claim 1, wherein said first terminals each have a contact portion disposed at one end thereof for the contact of a first external electronic device, and a press portion disposed at an opposite end thereof for pressing the respective second terminal; said second terminals each have a mounting portion disposed at one end thereof for connection to a second external electronic device and a resilient support for supporting the press portion of the respective first terminal.

3. The electrical connector as claimed in claim 1, wherein first terminals and said second terminals are metal plate members respectively made of different materials having different conductivity.

4. The electrical connector as claimed in claim 1, wherein said body has a recess adapted to accommodate an external electronic device; said first terminals are respectively mounted in said body and partially protruding over said recess.

5. The electrical connector as claimed in claim 1, wherein said first terminals and said second terminals are respectively arranged at right angles; said first terminals each have a press portion for pressing the respective second terminal and a sloping surface disposed at said press portion and facing the respective second terminal; said second terminals each have a spring arm extending in a perpendicular manner relative to the press portion of the respective first terminal for bearing the sloping surface of the press portion of the respective first terminal and stopping against a part of said body upon contact of the sloping surface of the press portion of the respective first terminal.

6. The electrical connector as claimed in claim 1, wherein said second terminals each have a mounting portion extending out of a bottom side of said body for connection to an external circuit board through a contact connection.

7. An electrical connector comprising:

a body, said body having a plurality of terminal slots;

a plurality of first terminals respectively mounted in said terminal slots of said body;

a plurality of second terminals respectively mounted in said terminal slots of said body in parallel to said first terminals each of second terminals having spring arms for compression contact with said first terminals respectively;

a holding down cover coupled to one said of said body and adapted to hold down an external electronic device; and a locking lever coupled to one side of said body opposite to said holding down cover and adapted to lock said holding down cover;

wherein said body is an insulative housing having at least one mounting through hole cut through top and bottom sides thereof, fastening means mounted in said at least one mounting through hole and adapted to affix said body to an external electronic device, and locating frames fixedly mounted in said body, said holding down cover and said locking lever are respectively pivotally coupled to said locating frames.

8. The electrical connector as claimed in claim 7, wherein said first terminals each have a contact portion disposed at one end thereof for the contact of a first external electronic device, a press portion disposed at an opposite end thereof for pressing the respective second terminal, and a sloping surface disposed at said press portion and facing the respective second terminal; said second terminals each have a mounting portion disposed at one end thereof for connection to a second external electronic device and a resilient support disposed at an opposite end thereof for supporting the respective first terminal, said resilient support having a spring arm extending in a perpendicular manner relative to the press portion of the respective first terminal for bearing the sloping surface of the press portion of the respective first terminal and stopping against a part of said body upon contact of the sloping surface of the press portion of the respective first terminal.

9. The electrical connector as claimed in claim 7, wherein said first terminals and said second terminals are metal plate members made of different metal materials having different conductivity.

10. The electrical connector as claimed in claim 7, wherein said second terminals each having a mounting portion extending out of a bottom side of said body for connection to an external circuit board through a contact connection.

* * * * *